US008818584B2

(12) United States Patent
Kickbusch

(10) Patent No.: US 8,818,584 B2
(45) Date of Patent: Aug. 26, 2014

(54) SYSTEM AND METHOD FOR MODIFYING SCHEDULES OF VEHICLES

(75) Inventor: Joel Kickbusch, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 151 days.

(21) Appl. No.: 13/311,211

(22) Filed: Dec. 5, 2011

(65) Prior Publication Data

US 2013/0144517 A1 Jun. 6, 2013

(51) Int. Cl.
*G05D 1/00* (2006.01)
*B61C 17/00* (2006.01)

(52) U.S. Cl.
USPC ..... 701/19; 105/26.05

(58) Field of Classification Search
USPC ..... 701/20, 23, 34.4, 19, 22, 119; 705/72.2, 705/176, 159, 35; 246/3, 63 A, 49, 187 B; 105/72.2, 176, 159, 35, 26.05
See application file for complete search history.

(56) References Cited

U.S. PATENT DOCUMENTS

| | | | |
|---|---|---|---|
| 7,395,141 | B1 | 7/2008 | Seck et al. |
| 7,500,436 | B2 | 3/2009 | Kumar et al. |
| 7,512,481 | B2 | 3/2009 | Julich et al. |
| 7,618,011 | B2 | 11/2009 | Oleski et al. |
| 7,669,534 | B2 | 3/2010 | Kumar et al. |
| 7,680,750 | B2 | 3/2010 | Daum et al. |
| 7,715,958 | B2 | 5/2010 | Kumar |
| 7,715,977 | B2 | 5/2010 | Julich et al. |
| 7,725,249 | B2 | 5/2010 | Kickbusch et al. |
| 7,734,383 | B2 | 6/2010 | Philp et al. |
| 7,797,088 | B2 | 9/2010 | Philp et al. |
| 7,813,846 | B2 | 10/2010 | Wills et al. |
| 7,882,789 | B2 | 2/2011 | Kumar et al. |
| 7,937,193 | B2 | 5/2011 | Philp et al. |
| 7,974,774 | B2 | 7/2011 | Kumar |
| 8,025,115 | B2 | 9/2011 | King et al. |
| 2005/0288832 | A1 | 12/2005 | Smith et al. |
| 2008/0109124 | A1 | 5/2008 | Daum et al. |
| 2008/0201027 | A1 | 8/2008 | Julich et al. |
| 2008/0288132 | A1 | 11/2008 | King et al. |
| 2009/0037039 | A1 | 2/2009 | Yu et al. |
| 2009/0099825 | A1 * | 4/2009 | Bollapragada et al. ..... 703/8 |

(Continued)

OTHER PUBLICATIONS

Search Report and Written Opinion from corresponding PCT Application No. PCT/US2012/064022 dated May 24, 2013.

(Continued)

*Primary Examiner* — Muhammad Shafi
(74) *Attorney, Agent, or Firm* — GE Global Patent Operation; John A. Kramer

(57) ABSTRACT

A system includes an interface module, a simulation module, and a resolution module. The interface module determines a captured state of vehicles traveling in a transportation network according to associated schedules and a proposed modification to the schedules. The captured state represents locations of the vehicles in the transportation network at a selected time. The simulation module simulates movement of the vehicles according to the proposed modification to the schedules. The movement of the vehicles is simulated from the selected time of the captured state of the vehicles. The resolution module determines potential ramifications from the movement of the vehicles that is simulated. The potential ramifications are representative of a simulated change in travel of the vehicles due to the proposed modification. The resolution module is further configured to use the potential ramifications for use in determining whether to implement the proposed modification in actual travel of the vehicles.

23 Claims, 4 Drawing Sheets

(56) References Cited

U.S. PATENT DOCUMENTS

| | | | |
|---|---|---|---|
| 2009/0118970 | A1 | 5/2009 | Daum et al. |
| 2009/0132113 | A1 | 5/2009 | Kumar et al. |
| 2009/0254233 | A1 | 10/2009 | Noffsinger et al. |
| 2010/0019726 | A1 | 1/2010 | Kumar |
| 2010/0023190 | A1 | 1/2010 | Kumar et al. |
| 2010/0043388 | A1 | 2/2010 | Mason et al. |
| 2010/0150705 | A1 | 6/2010 | Mason et al. |
| 2010/0153419 | A1 | 6/2010 | Daum et al. |
| 2010/0163687 | A1 | 7/2010 | Brand et al. |
| 2010/0185472 | A1 | 7/2010 | Goodermuth et al. |
| 2010/0241295 | A1 | 9/2010 | Cooper et al. |
| 2011/0051663 | A1 | 3/2011 | Cooper et al. |
| 2011/0060486 | A1 | 3/2011 | Meltser et al. |
| 2011/0099413 | A1 | 4/2011 | Cooper et al. |
| 2011/0106327 | A1 | 5/2011 | Zhou et al. |
| 2011/0106328 | A1 | 5/2011 | Zhou et al. |

OTHER PUBLICATIONS

Schassberger, U. et al., "High performance terminal planning systems for shunting stations", SIGNAL+DRAHT, DE, vol. 93, No. 5, pp. 24-30, Jan. 1, 2001.

* cited by examiner

SYSTEM AND METHOD FOR MODIFYING SCHEDULES OF VEHICLES

BACKGROUND

A transportation network for vehicles can include several interconnected routes on which the vehicles travel between locations. For example, a transportation network may be formed from interconnected railroad tracks with rail vehicles traveling along the tracks. The vehicles may travel according to schedules that dictate where and when the vehicles are to travel in the transportation network.

As the vehicles travel in the transportation network, one or more events may occur that cause a slowdown in travel of the vehicles, such as mechanical problems with the vehicles, damage to the routes of the transportation network, gridlock (e.g., a traffic jam) of the vehicles, and the like. When such events occur, some network planning systems allow an operator to re-route or otherwise change how the vehicles travel in the transportation network in an effort to increase the flow of movement of the vehicles or eliminate the gridlock.

Such re-routing and changing, however, may not be an instantaneous decision by the operator. Due to the interdependencies between the vehicles in the transportation network, the operator may need to consider a wide variety of factors in deciding how to change the movements of the vehicles. The selection and implementation of changes to the movements of the vehicles may take a significant amount of time. The operator may be unable to select and implement changes to the movements of the vehicles "on-the-fly" because the operator may be unable to consider the many potential outcomes of changing the movements of even a small number of the vehicles. Implementing changes on-the-fly can result in the operator making a bad situation worse by slowing down the flow of movement even more and/or increasing the congestion in the transportation network.

Moreover, as the operator is deciding on a plan of action to take with respect to changing movements of the vehicles, at least some of the vehicles may continue to move. For example, the operator may be basing his or her decisions on a static state of the vehicles in the transportation network that is no longer accurate. As a result, any changes determined by the operator may no longer work to a current state of the vehicles that is different than the previously examined static state.

A need exists for a system and method that permits the modification of schedules of vehicles traveling in a transportation network while gaining an understanding of the potential impact of different proposed changes to the movements of the vehicles, and also while considering changing positions of the vehicles while deciding which changes to implement in the movements of the vehicles.

BRIEF DESCRIPTION

In one embodiment, a system is provided that includes an interface module, a simulation module, and a resolution module. As used herein, the terms "unit" or "module" include a hardware and/or software system that operates to perform one or more functions. For example, a unit or module may include one or more computer processors, controllers, and/or other logic-based devices that perform operations based on instructions stored on a tangible and non-transitory computer readable storage medium, such as a computer memory. Alternatively, a unit or module may include a hard-wired device that performs operations based on hard-wired logic of a processor, controller, or other device. In one or more embodiments, a unit or module includes or is associated with a tangible and non-transitory (e.g., not an electric signal) computer readable medium, such as a computer memory. The units or modules shown in the attached figures may represent the hardware that operates based on software or hardwired instructions, the computer readable medium used to store and/or provide the instructions, the software that directs hardware to perform the operations, or a combination thereof.

The interface module is configured to determine a captured state of vehicles traveling in a transportation network according to associated schedules and a proposed modification to one or more of the schedules. The captured state represents locations of the vehicles in the transportation network at a selected time. The simulation module is configured to simulate movement of the vehicles according to the proposed modification to the one or more schedules. The movement of the vehicles is simulated from the selected time of the captured state of the vehicles. The resolution module is configured to determine one or more potential ramifications from the movement of the vehicles that is simulated. The potential ramifications are representative of a change in travel of one or more of the vehicles due to the proposed modification. The resolution module is further configured to use the one or more potential ramifications for use in determining whether to implement the proposed modification in actual travel of the vehicles.

In another embodiment, a method is provided that includes receiving a captured state of vehicles traveling in a transportation network according to associated schedules. The captured state represents locations of the vehicles in the transportation network at a selected time. The method also includes obtaining a proposed modification to one or more selected schedules of the schedules for one or more of the vehicles. The proposed modification directs the one or more of the vehicles to deviate from the one or more selected schedules. The method further includes simulating movement of the vehicles according to the proposed modification and subsequent to the selected time of the captured state and determining one or more potential ramifications on travel of one or more of the vehicles based on the movement that is simulated. Based on the one or more potential ramifications, the method also includes changing at least one of the selected schedules to include the proposed modification. The at least one of the selected schedules that includes the proposed modification is configured to be communicated to the one or more of the vehicles in order to direct further movement of the one or more of the vehicles.

In another embodiment, another system includes a resolution module that is configured to receive a plurality of proposed modifications to one or more schedules of one or more vehicles traveling in a transportation network. The plurality of proposed modifications directs the one or more vehicles to deviate from the one or more schedules during travel in the transportation network following a selected time. The resolution module is further configured to select one or more of the proposed modifications based on simulations of travel of the vehicles following the selected time. The one or more proposed modifications are selected based on potential ramifications on travel of the one or more of the vehicles subsequent to the selected time. The resolution module is further configured to direct a scheduling system to change at least one of the schedules into one or more modified schedules that include the one or more proposed modifications that are selected.

BRIEF DESCRIPTION OF THE DRAWINGS

The present inventive subject matter will be better understood from reading the following description of non-limiting embodiments, with reference to the attached drawings, wherein below.

DETAILED DESCRIPTION

One or more embodiments of the subject matter described herein provide systems and methods for modifying schedules of vehicles traveling in a transportation network in order to maintain flow of the vehicles through the transportation network. When an event occurs in the transportation network that slows down and/or stops movement of the vehicles, the current state of the vehicles may be captured (referred to herein as a "captured state") and provided to an off-line system, such as a system that does not communicate directly with the vehicles to control movement or change the schedules of the vehicles. The off-line system can determine (e.g., receive) one or more proposed modifications to the schedules of the vehicles and can simulate movement of the vehicles according to the modifications. For example, the movement of the vehicles subsequent to the captured state can be simulated one or more times according to the different proposed modifications to the schedules.

The simulated movement according to the various proposed modifications can be examined to determine which, if any, of the proposed modifications results in a reduced or eliminated slowdown in the movement of the vehicles, such as an increase in the throughput of the vehicles through the transportation network. If any such proposed modifications are identified, then one or more of the proposed modifications that are identified can be communicated to a system that is in communication with the vehicles. These proposed modifications can be used to change the schedules of the vehicles and to communicate the changed schedules to the vehicles. The vehicles may then move according to the changed schedules in order to actually reduce or eliminate the slowdown in the transportation network.

In one embodiment, while the movements of the vehicles are being simulated according to the various proposed modifications, the vehicles may continue to actually move in the transportation network. The actual movements of the vehicles may be used to update the simulations so that the simulations are based on the updated, actual movements of the vehicles instead of a previous state of the vehicles that is no longer applicable. Updating the simulations with such information can avoid the simulations inaccurately portraying the impact of one or more of the proposed modifications to the schedules on the actual travel of the vehicles.

Figure 1:
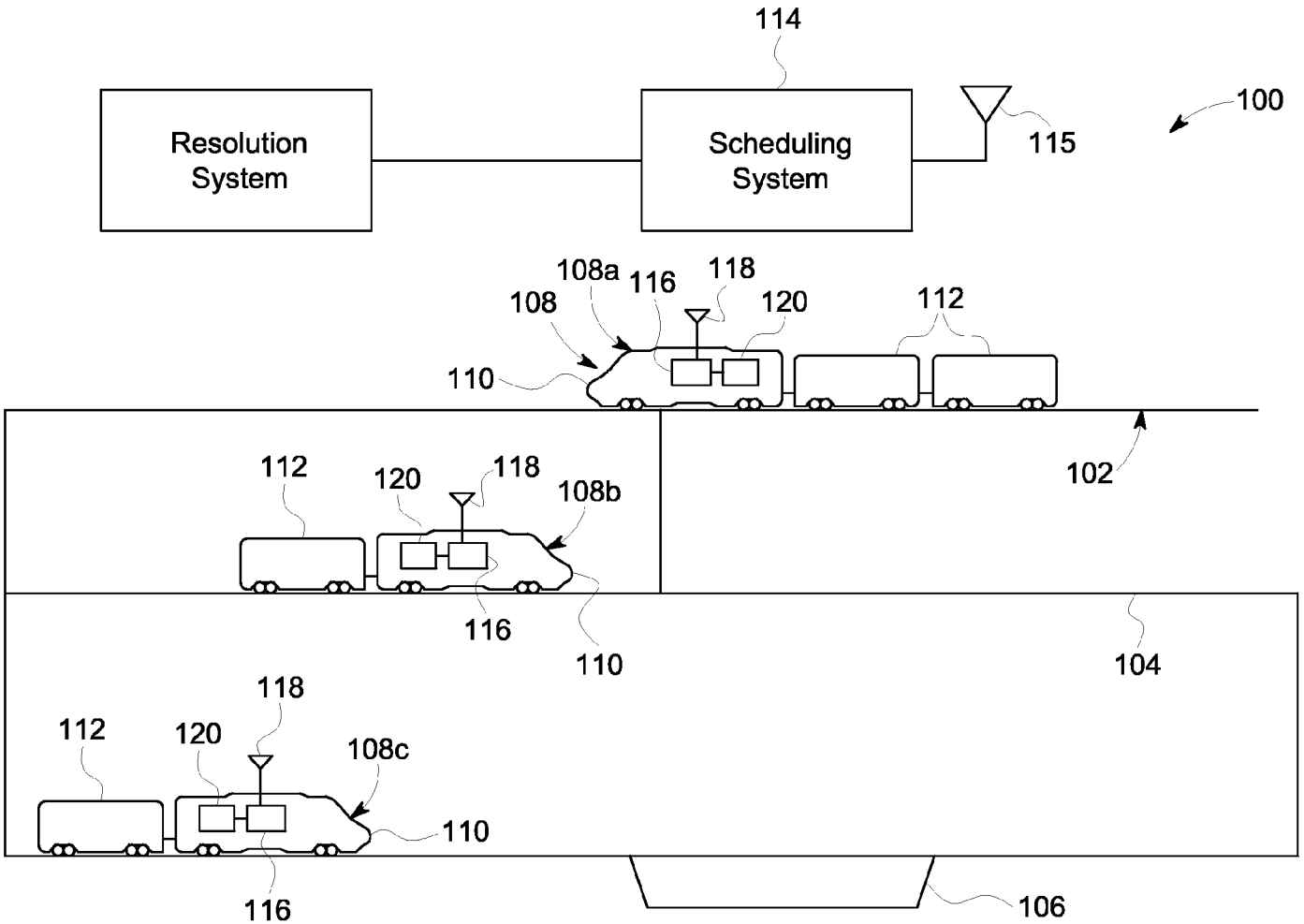
FIG. 1 is a schematic diagram of one embodiment of a transportation network.

FIG. 1 is a schematic diagram of one embodiment of a transportation network 100. The transportation network 100 includes a plurality of interconnected routes 102. While only one transportation network 100 is shown in FIG. 1, one or more other transportation networks 100 may be joined with and accessible to vehicles traveling in the illustrated transportation network 100. For example, one or more of the routes 102 may extend to another transportation network 100 such that vehicles can travel between the transportation networks 100. Different transportation networks 100 may be defined by different geographic boundaries, such as different towns, cities, counties, states, groups of states, countries, continents, and the like.

The illustrated routes 102 include main line routes 104 and siding section routes 106. The main line routes 104 may represent railroad tracks, roads, shipping paths, and the like, and the siding section routes 106 may represent relatively short diversions off of the main line routes 104. For example, the siding section routes 106 may represent smaller or lighter tracks, roads, paths, and the like. In one embodiment, the siding section routes 106 can be used in events between vehicles 108 traveling in the transportation network 100. If a main line route 104 can only allow for a single vehicle 108 to pass over a section of the main line route 104 in a single direction (e.g., a single railroad track), then two vehicles 108 can pass one another using the siding section route 106. For example, one of the vehicles 108 can pull off of the main line route 104 and onto the siding section route 106 to allow another vehicle 108 to pass (e.g., either in the same or opposite direction) on the main line route 104 before pulling back onto the main line route 104. The number of routes 102 shown in FIG. 1 is meant to be illustrative and not limiting on embodiments of the described subject matter.

Several vehicles 108 travel along the routes 102 in the transportation network 100. The vehicles 108 may concurrently travel in the transportation network 100 along the same or different routes 102. Travel of one or more vehicles 108 may be constrained to travel within the transportation network 100 (referred to herein as "intra-network travel"). Alternatively, one or more of the vehicles 108 may enter the transportation network 100 from another transportation network or leave the transportation network 100 to travel into another transportation network (referred to herein as "inter-network travel"). In the illustrated embodiment, the vehicles 108 are shown and described herein as rail vehicles or rail vehicle consists. However, one or more other embodiments may relate to vehicles other than rail vehicles or rail vehicle consists. For example, one or more of the vehicles 108 may represent other off-highway vehicles, automobiles, airplanes, marine vessels, and the like, and the routes 102 may represent other pathways of travel, such as roads, airline pathways, marine shipping pathways, and the like.

The vehicles 108 are referred to by the reference numbers 108*a*, 108*b*, and 108*c*. While three vehicles 108 are shown in FIG. 1, alternatively, a different number of vehicles 108 may be concurrently traveling in the transportation network 100. A vehicle 108 may include a group of powered units 110 (e.g., locomotives or other vehicles capable of self-propulsion) and/or non-powered units 112 (e.g., cargo cars, passenger cars, or other vehicles incapable of self-propulsion) that are mechanically coupled or linked together to travel along the routes 102.

A movement plan for the vehicles 108 traveling in the transportation network 100 may be determined by a scheduling system 114. The scheduling system 114 can include one or more devices, controllers, and the like, having hardware and/or software components that operate to provide various functions. As shown in FIG. 1, the scheduling system 114 can be disposed off-board (e.g., outside) the vehicles 108. For example, the scheduling system 114 may be disposed at a central dispatch office for a railroad company. The scheduling system 114 can create and communicate the schedules to the vehicles 108. The scheduling system 114 can include a wireless communication system 115, such as a radio frequency (RF) or cellular antenna and associated transceiver equipment, which wirelessly transmits the schedules to the vehicles 108. For example, the scheduling system 114 may transmit destination locations and associated arrival times to the vehicles 108. Alternatively, the scheduling system 114 may communicate the schedules to the vehicles 108 via another medium, such as through one or more conductive pathways (e.g., wires, cables, the rails of a railroad track, an overhead catenary, or the like).

The schedules of the vehicles 108 may be dependent on each other. As one example, two or more trains may need to coordinate schedules so that the trains can arrive at the same location in order to exchange cargo. As another example, different vehicles 108 may need to meet up with each other to exchange cargo, such as when a mining vehicle transports mined materials to a train, which transports the materials to a marine vessel, which then transports the materials to another location.

The vehicles 108 include control systems 116 disposed on-board the vehicles 108. The control systems 116 receive the schedules from the scheduling system 114 and generate control signals that may be used to control propulsion of the vehicles 108 through the transportation network 100. For example, the vehicles 108 may include wireless communication systems 118, such as RF or cellular antennas and associated transceiver equipment, which receive the schedules from the scheduling system 114. The control systems 116 on the vehicles 108 examine the schedules, such as by determining the scheduled destination location and scheduled arrival time for the respective vehicle 108, and generate control signals based on the schedules.

The vehicles 108 include propulsion subsystems 120, such as engines, traction motors, brake systems, and the like, that generate tractive effort to propel the vehicles 108 and braking effort to slow down or stop movement of the vehicles 108. The control signals generated by the control systems 116 may be used to automatically control tractive efforts and/or braking efforts provided by the propulsion subsystems 120 such that the vehicle 108 self-propels along the routes 102 to the destination location. The control signals may automatically control the propulsion subsystems 120, such as by automatically changing throttle settings and/or brake settings of the propulsion subsystems 120. Alternatively, the control signals may be used to prompt an operator of the vehicle 108 to manually control the tractive efforts and/or braking efforts of the vehicle 108. For example, the control system 116 may include an output device, such as a computer monitor, touchscreen, acoustic speaker, or the like, that generates visual and/or audible instructions based on the control signals. The instructions may direct the operator to manually change throttle settings and/or brake settings of the propulsion subsystem 120 of the vehicle 108.

A resolution system 122 is communicatively coupled with the scheduling system 114. The resolution system 122 may be connected with the scheduling system 114 by a communication link formed from one or more wired and/or wireless connections, such as wireless networks, cables, busses, and the like. The resolution system 122 can include one or more devices, controllers, and the like, having hardware and/or software components that operate to provide various functions. In one embodiment, the resolution system 122 receives locations and/or directions of travel of the vehicles 108 at a selected time. The locations and/or directions of travel of the vehicles 108 at the selected time can be referred to as a state of the vehicles 108, such as a captured state of the vehicles 108.

The resolution system 122 can determine (e.g., receive) proposed modifications to the schedules of one or more of the vehicles 108. The proposed modifications can include a change in a path to be taken by a vehicle 108 through the routes 102 from a current or starting location to a scheduled destination location, a change in the scheduled destination location, a change in a scheduled arrival time at the destination location, or the like. The proposed modifications may be provided to the resolution system 122 so that the resolution system 122 can simulate movement of the vehicles 108 according to changes in the schedules of one or more of the vehicles 108 that correspond with the proposed modifications. For example, the resolution system 122 can simulate movement of the vehicles 108 after the selected time at which the captured state of the vehicles 108 is obtained, with the simulated movement of the vehicles 108 being based on the schedules that are changed by the proposed modifications.

In one embodiment, the resolution system 122 may receive the proposed modifications to the schedules of the vehicles 108 when a slowdown event is identified in the transportation network 100. A slowdown event can include one or more of the vehicles 108 slowing down below a designated speed and/or being prevented from continuing to travel in the transportation network 100. For example, a slowdown event can occur when one or more vehicles 108 are forced to travel below a designated speed. The designated speed can be a speed limit of a route 102, a speed designated by the scheduling system 114, a speed limit designated by an energy management system on the vehicle 108 (e.g., a system that generates a trip plan for the vehicle 108 to travel while consuming less fuel and/or generating fewer emissions relative to travel without the trip plan), and the like. A slowdown event may occur when a gridlock or deadlock occurs, such as when one or more vehicles 108 are unable to continue moving in the transportation network 100 according to associated schedules or trip plans due to movements of other vehicles 108 or other vehicles 108 blocking continued movement of the one or more vehicles 108. For example, a traffic jam of several vehicles 108 may create a slowdown event. The above examples are not intended to be an exhaustive list of all potential slowdown events. The proposed modifications to the schedules may be provided to the resolution system 122 when other slowdown events occur. Alternatively, the proposed modifications may be provided to the resolution system 122 when an operator of the scheduling system 114 and/or resolution system 122 decides to provide the proposed modifications.

Upon receiving the proposed modifications, the resolution system 122 may simulate movement of the vehicles 108 according to the schedules that are modified by the proposed modifications. For example, if a proposed modification changes a destination location, a scheduled arrival time, and/or a path to be taken by a vehicle 108, then the resolution system 122 can simulate movement of the vehicle 108 according to the schedule of the vehicle 108, with the schedule being modified to include the changed destination location, the changed arrival time, and/or the changed path. One or more algorithms, such as computer software algorithms, may be used by the resolution system 122 to simulate the movements of the vehicles 108.

The simulation may estimate movements of several vehicles 108 in the transportation network 100 from the time at which the captured state of the vehicles 108 is obtained. The simulation may begin, or run, from the time of the captured state (e.g., the selected time). The simulation provides the resolution system 122 with information concerning potential ramifications of the proposed modifications to the schedules. The term "potential ramifications" can include the impact that implementing one or more of the proposed modifications may have or will have on the travel of one or more of the vehicles 108 in the transportation network 100 (e.g., the vehicle 108 having the schedule that is altered by a proposed modification and/or other vehicles 108), as determined by the simulation. For example, from the simulation, the resolution system 122 can determine the impact that changing one or more schedules of the vehicles 108 may have or will have on the travel of the vehicles 108 having the modified schedules and/or other vehicles 108 having schedules that are not modified in the simulation. The resolution system 122 can determine if the flow of the vehicles 108 in the transportation network 100 is improved, remains the same or approximately the same, or deteriorates (e.g., is degraded) by the proposed modifications to the schedules. As one example, the resolution system 122 can determine if the vehicles 108 with and/or without the modified schedules in the simulation arrive at associated destination locations at or later than scheduled arrival times. In situations where vehicles 108 arrive at the destination locations later than the scheduled arrival times in the simulation, the resolution system 122 may determine the differences between the scheduled arrival times and the actual arrival times.

The resolution system 122 can receive several different proposed modifications to the schedules and run several different simulations on travel of the vehicles 108. For example, the resolution system 122 can receive a first proposed modification and a second proposed modification to the schedule of one vehicle 108 or to the schedules of different vehicles 108. The resolution system 122 may run a first simulation that estimates movements of the vehicles 108 according to the first proposed modification and a second simulation that estimates movements of the vehicles 108 according to the second proposed modification. The resolution system 122 may compare the results of the two simulations and determine which of the simulations provides better results, such as which simulation reduces congestion in the transportation network 100, results in more vehicles 108 arriving at destination locations closer to the scheduled arrival times, and the like.

The resolution system 122 can generate output signals that represent the simulations or outcomes of the simulations, such as the potential ramifications of the simulations. These output signals may be used to manually determine which, if any, of the proposed modifications to the schedules may be implemented to actually alter the schedules of the vehicles 108. The output signals can be communicated to an output device that visually and/or audibly presents the potential ramifications to an operator of the resolution system 122 and/or the scheduling system 114. For example, the output device can include a monitor, touchscreen, or other display device that visually presents maps of simulated travel of the vehicles 108 according to the proposed modifications, textual and/or numerical data (e.g., graphs, charts, text, and the like) that represents the potential ramifications, and the like. Based on the output signals, the operator may then select one or more of the proposed modifications to be implemented into the actual schedules of the vehicles 108. The operator may direct the resolution system 122 to communicate such selected proposed modifications to the scheduling system 114. The scheduling system 114 can transmit the proposed modifications or modified schedules that are changed based on the proposed modifications to the vehicles 108.

Alternatively, the resolution system 122 may generate output signals that automatically cause the scheduling system 114 to transmit the proposed modifications or schedules that are changed based on the proposed modifications to the vehicles 108. For example, the resolution system 122 can select one or more proposed modifications for implementation in the schedules of the vehicles 108 based on a comparison of the potential ramifications obtained from the simulations. The resolution system 122 can select the proposed modifications that cause fewer vehicles 108 to arrive late to associated destination locations, the proposed modifications that cause fewer vehicles 108 to travel farther to the destination locations (e.g., and consume more fuel and/or generate more emissions along the way), the proposed modifications that cause improved flow of the vehicles 108 through the transportation network 100, and the like. The selected proposed modifications can be automatically sent to the scheduling system 114 as the output signals for implementation in the actual schedules of the vehicles 104.

The resolution system 122 may be referred to as an "offline" system in that the resolution system 122 can simulate movement of the vehicles 108 and determine the potential ramifications of the proposed modifications to the schedules without or before actually implementing any of the proposed modifications in the actual travel of the vehicles 108. By simulating several different proposed modifications and examining the potential ramifications of the modifications before sending the modifications to the vehicles 108, the resolution system 122 and/or operator can be selective in which proposed modifications are to be used based on the simulated impact of the modifications.

The resolution system 122 may periodically update the simulations of the vehicles 108 based on actual movements of the vehicles 108. For example, prior to starting a simulation, the resolution module 122 can receive the captured state of the vehicles 108. The simulations performed by the resolution system 122 may begin with the vehicles 108 based on the captured state that is received. In one embodiment, the resolution system 122 receives one or more updates to the captured state of the vehicles 108 based on actual movements of the vehicles 108 after the captured state is obtained. For example, an updated state of the vehicles 108 may be obtained, where the updated state includes locations and/or directions of travel of the vehicles 108 at a selected time that is subsequent to the time of the captured state. The updated states may be provided several times to the resolution system 122 as the simulations are run. The resolution system 122 can use one or more of the updated states to update or modify the simulations of travel in the transportation network 100.

Figure 2:
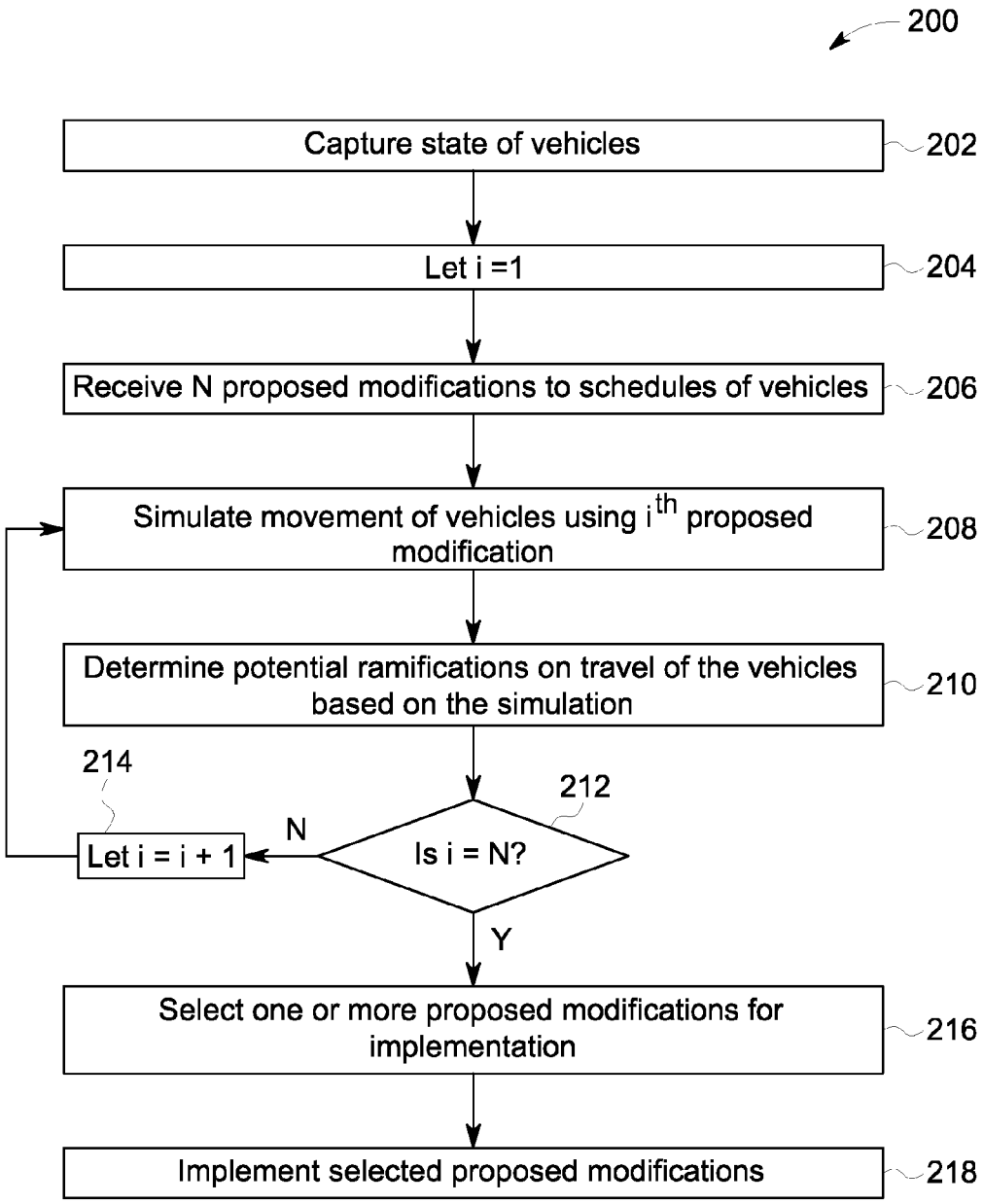
FIG. 2 is a flowchart of one embodiment of a method for modifying schedules of vehicles traveling in a transportation network.

FIG. 2 is a flowchart of one embodiment of a method 200 for modifying schedules of vehicles traveling in a transportation network. The method 200 may be used in conjunction with one or more embodiments of the resolution system 122 and/or the scheduling system 114 shown in FIG. 1 and described herein. The discussion of the method 200 refers to the components shown in the other figures. However, alternatively, the method 200 may be used with one or more other systems or components.

At 202, a state of vehicles 108 traveling in a transportation network 100 is captured. The captured state of the vehicles 108 may include the locations and/or directions of travel of the vehicles 108. The captured state of the vehicles 108 is captured at a selected time, such as a time selected by an operator of the scheduling system 114 or the resolution system 122 or at a time automatically selected by the scheduling system 114 or resolution system 122. For example, the captured state may be obtained when a throughput parameter of the transportation network 100 falls below a designated, nonzero threshold, as described below.

Figure 3:
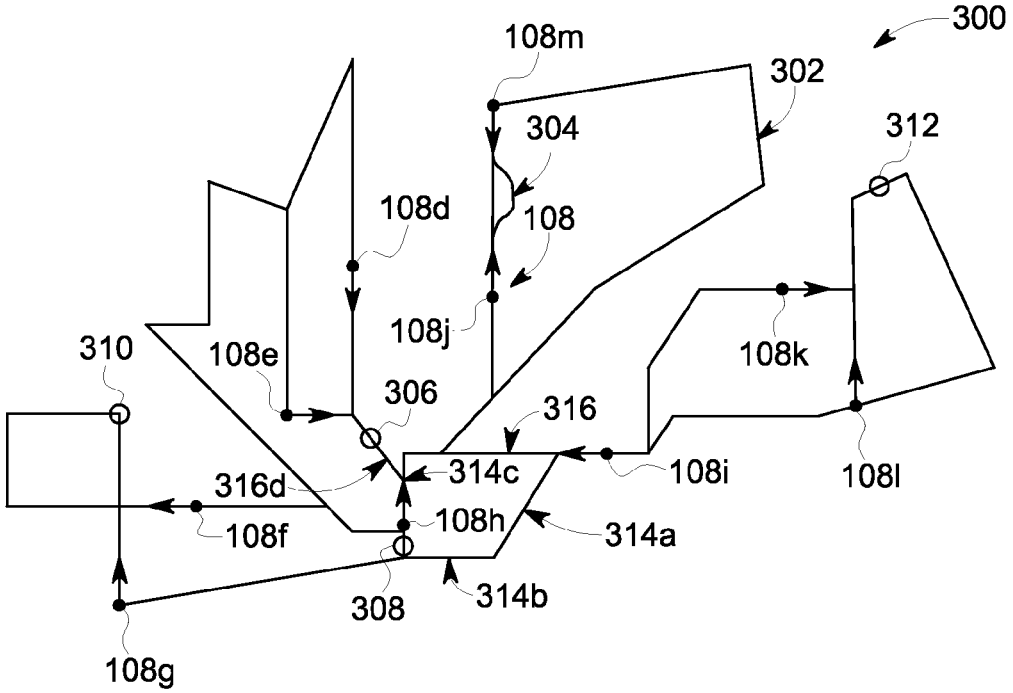
FIG. 3 is a schematic diagram of a captured state of vehicles shown in FIG. 1 traveling in a transportation network at a selected time in accordance with one example.

FIG. 3 is a schematic diagram of a captured state of the vehicles 108 traveling in a transportation network 300 at a selected time in accordance with one example. The vehicles 108 are individually referred to by reference numbers 108*d*, 108*e*, 108*f*, and so on. The transportation network 300 may be similar to the transportation network 100 (shown in FIG. 1).

For example, the transportation network 300 may be formed from several interconnected routes 302 that are similar to the routes 102 (shown in FIG. 1). The transportation network 300 includes one or more siding section routes 306 that may be similar to the siding section route 106 (shown in FIG. 1). The locations of the vehicles 108 are shown in FIG. 3, along with arrows 304 that represent the directions of travel of the vehicles 108 in the transportation network 300 at the selected time of the captured state. The captured state shown in FIG. 3 may be the state of the vehicles 108 that is captured at 202 of the method 200 shown in FIG. 2. The captured state may be recorded and/or reported to the resolution system 122 as geographic locations of the vehicles 108 along with or without the directions of travel of the vehicles 108 and/or associated information (such as rate of travel).

Returning to the discussion of the method 200 shown in FIG. 2, at 204, an initialization operation may be performed. The initialization operation may be used to allow a system enacting the method 200 to examine several proposed modifications to the schedules of the vehicles 108, as described below. In the illustrated embodiment, "i" represents integer values associated with different proposed modifications. For example, a first proposed modification is associated with a value for i of 1, a second proposed modification is associated with a value for i of 2, and so on.

At 206, one or more proposed modifications are received. The proposed modifications may be received as manual input from an operator and/or may be previously determined modifications. Previously determined modifications may be stored in a tangible and/or non-transitory (e.g., not a transient signal) computer readable storage medium, such as a memory, that can be accessed by the resolution system 122. The number of proposed modifications that are received or obtained is represented by the integer value of "N." For example, if five proposed modifications are obtained, then the value of N is 5. If twelve proposed modifications are obtained, then the value of N is 12.

With respect to the example shown in FIG. 3, a first proposed modification may include changing a destination location of one or more of the vehicles 108. For example, the vehicle 108*i* may have a schedule with a destination location 306. As shown in FIG. 3, however, several vehicles 108*d*, 108*e*, and 108*h* also are converging toward the area near the destination location 306. In order to avoid gridlock, deadlock, or a general slowdown in the travel of the vehicles 108*d*, 108*e*, 108*h*, and/or 108*i* in the area near the destination location 306, the destination location 306 for the vehicle 108*i* may be changed from the location 306 to a different destination location 308.

A second proposed modification may include changing a scheduled arrival time of a vehicle 108 at a destination location. For example, the vehicle 108*g* may have a schedule with an arrival time at a destination location 310 at 13:00 hours and the vehicle 108*l* may have a schedule with an arrival time at a destination location 312 at 14:00 hours. A second proposed modification may include delaying the arrival time of the vehicle 108*g* to 13:30 hours and moving up the arrival time of the vehicle 108*l* to 13:50 so that the vehicle 108*g* travels more slowly toward the destination location 310 and the vehicle 108*l* travels faster toward the destination location 312.

A third proposed modification may include changing a path taken by a vehicle 108 to reach a destination location. Changing a path taken by a vehicle 108 can include changing which routes 302 are traversed by the vehicle 108 from a current location toward a destination location and/or directing the vehicle 108 to pull off onto a siding section route 304 for a period of time to allow another vehicle 108 to pass on a route 302. For example, the vehicle 108*j* may have a scheduled path that causes the vehicle 108*j* to travel in the illustrated direction on the route 302 shown in FIG. 3. However, another vehicle 108*m* also has a scheduled path that directs the vehicle 108*m* to travel in an opposite direction on the same route 302 as the vehicle 108*j*. Due to one or more unscheduled circumstances, such as one or more of the vehicles 108 traveling more slowly than scheduled, the vehicles 108*j*, 108*m* may be headed toward each other along the route 302 shown in FIG. 3. The third proposed modification may include directing the vehicle 108*j* to pull off of the route 302 onto the siding section route 304 to allow the vehicle 108*m* to pass on the route 302, before the vehicle 108*j* pulls back onto the route 302.

Alternatively or additionally, the third proposed modification may include directing the vehicle 108*i* to change which routes 302 are used to travel to the destination location 306. For example, instead of taking the previously scheduled section 316 of the routes 302 to arrive at the destination location 306, the third proposed modification may involve the vehicle 108*i* taking the sections 314*a*, 314*b*, 314*c*, and 314*d* to arrive at the destination location 306.

At 208, movement of the vehicles 108 is simulated according to the $i^{th}$ proposed modification to the schedules. In continuing with the above examples, movement of the vehicles 108 is simulated according to the first proposed modification. The simulation can estimate movements of the vehicles 108 with the vehicle 108*i* changing the destination location from the location 306 to the location 308. As described above, the movements of the vehicles 108 may be estimated based on the schedules of the vehicles 108 and/or on updated locations and/or directions of travel of the vehicles 108 that are acquired after the captured state is acquired.

At 210, potential ramifications on travel of the vehicles 108 are determined based on the simulation. For example, with respect to the first proposed modification, the impact on the travel of the vehicles 108, including the vehicle 108*i*, is determined when the destination location of the vehicle 108*i* is changed from the location 306 (shown in FIG. 3) to the location 308 (shown in FIG. 3). The impact may include a negative potential ramification, such as interfering with movement of another vehicle 108 (e.g., slowing or blocking continued movement of the other vehicle 108). Alternatively, the impact may include a positive potential ramification, such as not interfering with movement (e.g., avoiding slowing or blocking movement) of another vehicle 108, such as the vehicles 108*d*, 108*e*, and/or 108*h*, where travel without the first proposed modification may interfere with movement of the vehicles 108*d*, 108*e*, 108*h*.

In one embodiment, potential ramifications of not implementing the proposed modification are determined. For example, the resolution system 122 may simulate movement of the vehicles 108 without implementing any of the proposed modifications and determine the potential ramifications. The simulation of travel of the vehicles 108 without including the proposed modifications may act as a baseline for comparison with the simulations that include one or more of the proposed modifications.

The potential ramifications may be measured as a difference in simulated estimated times of arrival (ETA) of one or more vehicles 108 between travel using the proposed modification and not using the proposed modification. For example, the resolution system 122 may simulate travel of the vehicles 108 without the proposed modification and calculate the ETAs of the vehicles 108 at associated destination locations. The resolution system 122 can simulate travel of the vehicles 108 with the proposed modification (e.g., changing the destination location from the location 306 to the location 308 for the vehicle 108*i*) and calculate the ETAs of the vehicles 108 at the destination locations. The individual, summed, averaged, or other statistical measure of the differences between the ETAs with and without the proposed modification can represent a potential ramification.

Alternatively or additionally, the potential ramification may be measured as a change in a throughput parameter of the transportation network 300. The throughput parameter of the transportation network 300 may be estimated using a simulation of travel in the transportation network 300 with the proposed modification (e.g., the first proposed modification) and may be estimated using a simulation of travel without the proposed modification. The difference in the throughput parameters may represent the potential ramification.

The throughput parameters may be based on the schedules (e.g., with and without the proposed modifications) of the vehicles 108 and deviations from the schedules by the vehicles 108 in the simulations of travel. For example, statistical measures of estimated adherence by the vehicles 108 to the schedules may be calculated during the simulations. The statistical measures of estimated adherence represent how closely the vehicles 108 adhere to the schedules (e.g., with and without the proposed modifications) as the vehicles 108 travel in the simulations. In the simulations, the vehicles 108 may adhere to the schedules by proceeding toward the scheduled destinations to arrive at the scheduled arrival times. The statistical measures of estimated adherence for the vehicles 108 may be based on or include the ETAs of the vehicles 108 during the simulations. If the ETA for a vehicle 108 is the same as or within a predetermined time window of the scheduled arrival time, then a relatively large statistical measure of estimated adherence may be calculated for the vehicle 108. As the ETA differs from the scheduled arrival time (e.g., by occurring after the scheduled arrival time), the statistical measure of estimated adherence may decrease.

Alternatively, the vehicle 108 may adhere to the schedules by arriving at or passing through scheduled waypoints at times that correspond with the schedules of the vehicles 108 during the simulations. As differences between the times that the vehicles 108 arrive at or pass through scheduled waypoints and the times that the vehicles 108 should arrive at or pass through the waypoints according to the schedules increase during the simulations, the statistical measures of estimated adherence for the vehicles 108 may decrease. Conversely, as these differences decrease, the statistical measure of estimated adherence may increase. Alternatively, the statistical measures of estimated adherence to the schedules may be based on the number of scheduled locations or waypoints that the vehicles 108 arrive early or late in the simulations (e.g., not at the scheduled times). In another embodiment, the statistical measures of estimated adherence by the vehicles 108 may be based on the number or percentage of scheduled locations or waypoints that the vehicles 108 arrive on time (e.g., at a scheduled time or within the time buffer of the scheduled time) in the simulations. In another embodiment, the statistical measures of adherence may be based on the summed total time differences between the times at which the vehicles 108 are scheduled to arrive at or pass by locations or waypoints and the times at which the vehicles 108 arrive at or pass the locations or waypoints in the simulations.

The throughput parameters for the transportation network 300, or a portion thereof, may be calculated based on the statistical measures of estimated adherence for the vehicles 108 in the simulations. For example, a throughput parameter may be an average, median, or other statistical calculation of the statistical measures of adherence for the vehicles 108 in a simulation. The throughput parameter may be calculated based on the statistical measures of adherence for all, substantially all, a supermajority, or a majority of the vehicles 108 in a simulation.

As described above, the potential ramifications between simulations that include a proposed modification to schedules of one or more vehicles 108 and simulations that do not include the proposed modification can include or represent a difference between the throughput parameters associated with the different simulations. A decrease in the throughput parameters from a simulation that does not include a proposed modification to a simulation that includes the proposed modification may indicate that the proposed modification will slow down or restrict the flow of the vehicles 108 through the transportation network 300. On the other hand, an increase in the throughput parameter may indicate that the proposed modification will speed up or increase the flow of the vehicles 108 in the transportation network 300.

At 212, a determination is made as to whether the proposed modification being examined is the last of the proposed modifications. For example, if the currently examined proposed modification is the first proposed modification (e.g., i=1) and there are three proposed modifications to examine (e.g., N=3), then additional proposed modifications may need to be examined. As a result, flow of the method 200 may continue to 214. Otherwise, flow of the method 200 continues to 216.

At 214, the number of the proposed modifications being examined is increased. For example, if the previously examined proposed modification was the first proposed modification (e.g., i=1), then the next proposed modification to be examined is the second proposed modification (e.g., i=i+1=1+1=2). Flow of the method 200 may then return to 208.

As described above, at 208, movement of the vehicles 108 is simulated according to the $i^{th}$ proposed modification to the schedules, or the second proposed modification. For example, the simulation can estimate movements of the vehicles 108 with the scheduled arrival time of the vehicle 108*g* being delayed from 13:00 hours to 13:30 hours and the arrival time of the vehicle 108*l* being advanced from 14:00 hours to 13:50 hours.

At 210, the potential ramifications on travel of the vehicles 108 are determined based on the simulation. For example, with respect to the second proposed modification, the impact on the travel of the vehicles 108, including the vehicles 108*g*, 108*l*, is determined when the arrival times of the vehicles 108*g*, 108*l* are changed. As described above, the impact may include negative potential ramifications, such as the simulated travel of the vehicles 108 falling more behind schedule and/or the throughput parameter of the transportation network 300 decreasing. Alternatively, the impact may include positive potential ramifications, such as the simulated travel of the vehicles 108 moving closer toward the schedules and/or the throughput parameter increasing.

At 212, a determination is made as to whether the proposed modification being examined is the last of the proposed modifications. For example, if the currently examined proposed modification is the second proposed modification (e.g., i=2) and there are three proposed modifications to examine (e.g., N=3), then additional proposed modifications may need to be examined. In the present example, the second proposed modification is not the last proposed modification, so flow of the method 200 continues to 214.

At 214, the number of the proposed modifications being examined is increased. For example, as the second proposed modification (e.g., i=2) was just examined, then the next proposed modification to be examined is the third proposed modification (e.g., i=i+1=2+1=3). Flow of the method 200 then returns to 208.

At 208, movement of the vehicles 108 is simulated according to the $i^{th}$ proposed modification to the schedules, or the third proposed modification. For example, the simulation can estimate movements of the vehicles 108 with the scheduled path of the vehicle 108*j* being changed and/or scheduled path of the vehicle 108*i* being changed, as described above.

At 210, the potential ramifications on travel of the vehicles 108 are determined based on the simulations. For example, with respect to the third proposed modification, the impact on the travel of the vehicles 108, including the vehicles 108*i* and/or 108*j*, is determined when the scheduled paths of the vehicles 108*i* and/or 108*j* are changed. As described above, the impact may include negative potential ramifications or positive potential ramifications.

At 212, a determination is made as to whether the proposed modification being examined is the last of the proposed modifications. For example, if the currently examined proposed modification is the third proposed modification (e.g., i=3) and there are three proposed modifications to examine (e.g., N=3), then no more additional proposed modifications may need to be examined. In the present example, the third proposed modification is the last proposed modification, so flow of the method 200 continues to 216.

At 216, one or more of the proposed modifications are selected for implementation into the actual travel of the vehicles 108. The proposed modifications that are selected may be selected by comparing the potential ramifications associated with the proposed modifications with each other, and/or with the potential ramifications associated with the simulation that did not include the proposed modifications. As one example, the throughput parameters associated with the proposed modifications may be compared and the proposed modifications having greater throughput parameters than one or more other proposed modifications may be selected. Alternatively, the differences between the ETAs of the vehicles 108 and the scheduled arrival times of the vehicles 108 in the simulations may be compared to determine which of the proposed modifications results in lower differences.

At 218, the proposed modifications that are selected are implemented in the actual travel of the vehicles 108. With respect to the above examples, if the first proposed modification is selected as a selected modification, then the change in the destination location from the location 306 to the location 308 (shown in FIG. 3) may be communicated to the vehicle 108*i*. The selected modification may be communicated from the resolution module 122 to the scheduling system 114, which may then directly communicate (e.g., without communicating to the vehicle 108 via a third component that is outside of the scheduling system 114 and the vehicle 108) the selected modification or a modified schedule that includes the selected modification to the vehicles 108. Alternatively, if none of the proposed modifications are selected, then no modifications may be sent to the vehicles 108.

Figure 4:
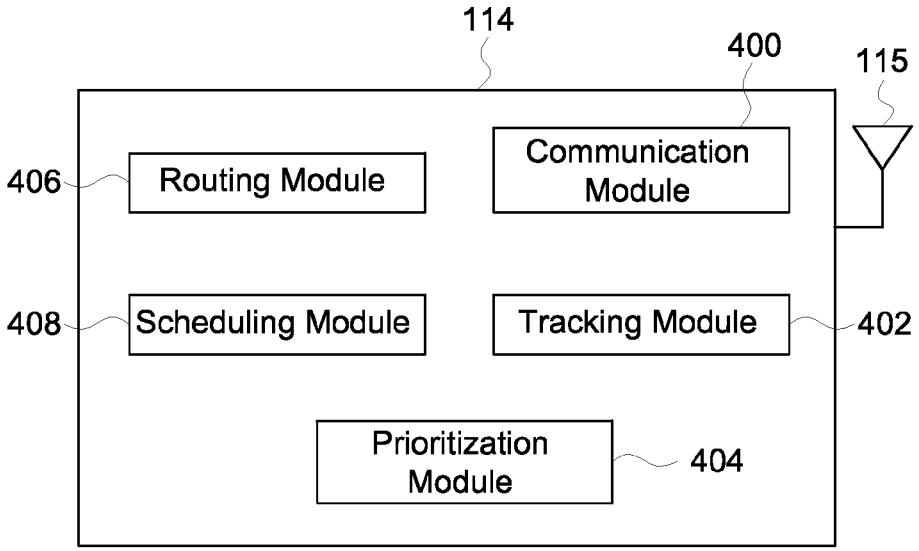
FIG. 4 is a schematic illustration of one embodiment of a scheduling system shown in FIG. 1.

FIG. 4 is a schematic illustration of one embodiment of the scheduling system 114. The scheduling system 114 can include several modules that perform various operations described herein. The modules may be communicatively coupled to communicate information between the modules, such as by being connected by wired and/or wireless connections.

The scheduling system 114 includes a communication module 400 that controls communication with the scheduling system 114. The communication module 400 may be communicatively coupled with the wireless communication system 115 and/or a wired connection to transmit and/or receive information (e.g., in data packets) with the vehicles 108 (shown in FIG. 1) and/or the resolution system 122 (shown in FIG. 1), and the like.

The scheduling system 114 includes a tracking module 402 that monitors movement and/or locations of the vehicles 108 (shown in FIG. 1) in the transportation network. The tracking module 402 may receive reports of current positions of the vehicles 108 from the vehicles 108. For example, the vehicles 108 may include position determining devices, such as global positioning system receivers, that provide geographic coordinates of where the vehicles 108 are located. The position determining devices can transmit these locations to the tracking module 402. Alternatively, one or more devices (e.g., wayside devices) may be disposed alongside the routes (shown in FIG. 1). These devices may report when a vehicle 108 passes the devices to the tracking module 402. Based on known locations of these devices, the tracking module 402 can determine where various vehicles 108 are located in the transportation network.

The tracking module 402 determines the state (e.g., locations and/or directions of travel) of the vehicles 108 (shown in FIG. 1) for the resolution module 122 (shown in FIG. 1). For example, the tracking module 402 can identify the locations of the vehicles 108 as described above and the directions of travel of the vehicles 108 based on previous locations of the vehicles 108, as reported by the vehicles 108, and/or from the schedules of the vehicles 108. The tracking module 402 captures the locations and/or directions of travel of the vehicles 108 as the captured state and reports the captured state to the resolution system 114 via the communication module 400. As described above, the tracking module 402 may acquire updated states of the vehicles 108 subsequent to the captured state and provide the updated states to the resolution module 122 so that the resolution module 122 can incorporate the updated locations and/or directions of travel of the vehicles 108 in the simulations.

In one embodiment, the tracking module 402 may determine throughput parameters for the transportation network. For example, the tracking module 402 can monitor the flow of travel in the transportation network and, if the throughput parameter drops below a designated, non-zero threshold indicative of a slowdown event in the transportation network, the tracking module 402 may notify an operator and/or automatically notify the resolution system 122 (shown in FIG. 1). The tracking module 402 can notify the operator and/or resolution system 122 to being obtaining and/or examining proposed modifications to schedules of the vehicles 108 (shown in FIG. 1).

The scheduling system 114 includes a prioritization module 404 that assigns priorities to the vehicles 108 (shown in FIG. 1). The prioritization module 404 may assign the priorities to the vehicles 108 to indicate which vehicles 108 take precedence over other vehicles 108 during travel within the transportation network. For example, the priorities of the vehicles 108 may indicate which of the vehicles 108 should be scheduled to arrive at one or more destination locations earlier than other vehicles 108, which vehicles 108 take precedence when two or more vehicles 108 need to travel along the same section of one or more routes (shown in FIG. 1), and the like. The priorities may be used limit the proposed modifications that can be introduced into the simulations run by the resolution module 122 and/or to inform an operator making the proposed modifications that one or more of the proposed modifications conflicts with the assigned priorities. For example, if a proposed modification causes a vehicle 108 with a lower priority to take precedence over a vehicle 108 having a higher priority during an interaction between the vehicles 108 (as reported to the resolution module 122 from the prioritization module 404), the resolution module 122 may prohibit use of the proposed modification or notify an operator of the conflict between the priorities.

A routing module 406 of the scheduling system 114 determines the routes to be taken by the vehicles 108 (shown in FIG. 1) to reach associated destination locations. The routing module 406 may monitor which routes are available for travel by the vehicles 108, and may keep track of which routes or sections of the routes are unavailable for travel due to repair, maintenance, damage, and the like.

The routing module 406 may limit the proposed modifications that can be introduced into the simulations run by the resolution module 122 and/or to inform an operator making the proposed modifications that one or more of the proposed modifications conflicts with the assigned priorities. For example, if a proposed modification causes a vehicle 108 to travel over an unavailable route (as determined by the routing module 406 and communicated to the resolution system 122), the resolution system 122 may prohibit use of the proposed modification or notify an operator of the unavailability of the route.

A scheduling module 408 of the scheduling system 114 creates and/or modifies the schedules of the vehicles 108 (shown in FIG. 1). The scheduling module 408 may communicate with one or more other modules, such as the tracking module 402, the prioritization module 404, and/or the routing module 406 to form the schedules. The scheduling module 408 reports the schedules of the vehicles 108 to the resolution module 122 (shown in FIG. 1) for use in the simulations. The scheduling module 408 receives the selected modifications to the schedules of the vehicles 108 from the resolution module 122. The scheduling module 408 can report the selected modifications to the vehicles 108 having schedules that are changed by the modifications, or may modify the schedules of the vehicles 108 and send the modified schedules to the vehicles 108 for use in traveling in the transportation network.

Figure 5:
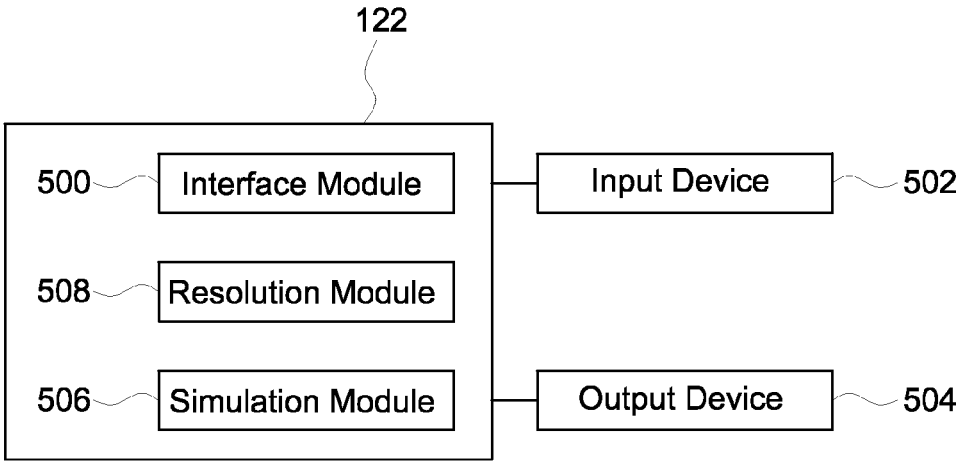
FIG. 5 is a schematic illustration of one embodiment of a resolution system shown in FIG. 1.

FIG. 5 is a schematic illustration of one embodiment of the resolution system 122. The resolution system 122 can include several modules that perform various operations described herein. The modules may be communicatively coupled to communicate information between the modules, such as by being connected by wired and/or wireless connections.

The resolution system 122 includes an interface module 500 that communicates with the scheduling system 114 (shown in FIG. 1). The interface module 500 may receive the captured state, updated states, schedules, and the like, from the scheduling system 114. The interface module 500 can communicate the selected modifications to the schedules of the vehicles 108 (shown in FIG. 1) to the scheduling system 114. As described above, the resolution system 122 may be an off-line system in that the resolution system 122 does not communicate directly with the vehicles 108. Instead, the interface module 500 can communicate the selected modifications to the schedules to the scheduling system 114, which transmits the modifications to the vehicles 108.

In the illustrated embodiment, the interface module 500 communicates with an input device 502 and an output device 504. The input device 502 may include a keyboard, microphone, touchscreen, electronic mouse, joystick, and/or other device, to receive input from an operator. The input device 502 may be used to receive manually selected proposed modifications to the schedules and/or notifications of when to obtain or update a state of the vehicles 108 (shown in FIG. 1). The output device 504 may include an electronic display, monitor, speaker, tactile device, and/or other device that visually, audibly, and/or tactually notifies an operator of the output signals of the resolution system 122. The output signals may represent the simulations of travel of the vehicles 108, the potential ramifications of the proposed modifications, the states of the vehicles 108, conflicts between proposed modifications and the priorities of the vehicles 108 and/or availability of routes in the transportation network, and the like.

The resolution system 122 includes a simulation module 506 that simulates movement of the vehicles 108 (shown in FIG. 1) with and/or without the proposed modifications to the schedules of the vehicles 108. The simulation module 506 may employ one or more algorithms, such as software algorithms or programs, to simulate the movements of the vehicles 108 according to the schedules or modified schedules. In one embodiment, the algorithms used to simulate the movements of the vehicles 108 may be commercially and/or otherwise publicly available movement simulation programs. These algorithms may receive, as input, the schedules of the vehicles 108, the modified schedules and/or modifications to the schedules of the vehicles 108, the captured state of the vehicles 108 (e.g., last known locations, starting locations, and/or associated times) of the vehicles 108, the destinations of the vehicles 108, the layout of the transportation network (e.g., the locations, intersections, and/or other information related to relative locations of the routes on which the vehicles 108 travel), operational information of the vehicles 108 (e.g., the tractive efforts capable of being produced, the braking efforts capable of being produced, the weight of the vehicles 108, the size of the vehicles 108, the health of the vehicles 108, and the like), operational information of the routes (e.g., locations and/or statuses of switches at intersections of routes, slow orders, areas under repair, speed limits of the routes, grades of the routes, curvatures of the routes, and the like), separation distances that are to be maintained between the vehicles 108 (e.g., buffer distances to avoid contact between the vehicles 108), and the like. This information that is input into the algorithms may be provided manually (by an operator using an input device such as a keyboard, electronic mouse, stylus, and the like, at a computing device that runs the algorithms) and/or automatically, such as by being downloaded from the scheduling system 114 and/or scheduling module 408.

The algorithms may simulate movement of the vehicles 108 by assuming that each of the vehicles 108 travel at the speed limits and/or at upper speeds capable of being produced by the vehicles 108. The algorithms can simulate how the vehicles 108 will concurrently move in the transportation network while employing real-world rules to avoid impractical results. For example, the algorithms may not simulate two vehicles 108 occupying the same points or volumes in space at the same time. From these simulations, the algorithms can determine how the vehicles 108 will or may move in the transportation network relative to each other.

The resolution system 122 includes a resolution module 508 that determines the potential ramifications on travel of the vehicles 108 (shown in FIG. 1) due to the proposed modifications during the simulations of the simulation module 506. As described above, the resolution module 508 may calculate changes in throughput parameters of the transportation network, differences between ETAs and scheduled arrival times of the vehicles 108, and the like, from the simulations. The potential ramifications can be communicated to the output device 504 via the interface module 500 so that an operator can view the potential ramifications and select one or more of the proposed modifications for implementation in the schedules of the vehicles 108. Alternatively, the resolution module 508 may automatically select a proposed modification based on a comparison of the potential ramifications, as described above. When the proposed modifications are selected for implementation, the resolution module 508 may communicate the selected modifications to the scheduling system 114 (shown in FIG. 1) via the interface module 500.

In another embodiment, a system is provided that includes an interface module, a simulation module, and a resolution module. The interface module is configured to determine a captured state of vehicles traveling in a transportation network according to associated schedules and a proposed modification to one or more of the schedules. The captured state represents locations of the vehicles in the transportation network at a selected time. The simulation module is configured to simulate movement of the vehicles according to the proposed modification to the one or more of the schedules. The movement of the vehicles is simulated from the selected time of the captured state of the vehicles. The resolution module is configured to determine one or more potential ramifications from the movement of the vehicles that is simulated. The potential ramifications are representative of a simulated change in travel of one or more of the vehicles due to the proposed modification. The resolution module is further configured to use the one or more potential ramifications to determine whether to implement the proposed modification in actual travel of the vehicles.

In another aspect, the interface module is configured to communicate the proposed modification to a scheduling system for implementation in the actual travel of the vehicles and the resolution module is configured to determine the one or more potential ramifications prior to the scheduling system implementing the proposed modification in the one or more of the schedules.

In another aspect, the transportation network is associated with a throughput parameter that is indicative of flow of the vehicles traveling in the transportation network. The one or more potential ramifications on travel of the one or more vehicles can include a simulated change in the throughput parameter.

In another aspect, the interface module is configured to receive an update to the captured state of the vehicles that reflects changes in actual movements of the vehicles subsequent to the selected time of the captured state. The simulation module can be configured to simulate the movement of the vehicles based on the updated to the captured state of the vehicles.

In another aspect, the interface module is configured to obtain the captured state of the vehicles in response to a slowdown event being identified in the transportation network. The slowdown event reduces or prevents continued travel of one or more of the vehicles.

In another aspect, the interface module is configured to receive a plurality of the proposed modifications and the simulation module is configured to generate a plurality of different simulations of travel of the vehicles based on the plurality of proposed modifications. The resolution module can be configured to determine the one or more potential ramifications from the plurality of different simulations. The resolution module can be further configured to select at least one of the proposed modifications based on a comparison of the proposed ramifications.

In another aspect, the interface module is configured to receive the proposed modification from a user.

In another aspect, the captured state of the vehicles includes at least one of locations of the vehicles or directions of travel of the vehicles at the selected time.

In another aspect, the proposed modification includes one or more of a change in a scheduled arrival time of one or more of the selected vehicles at a scheduled destination location, a change in the scheduled destination location of one or more of the selected vehicles, or a deviation from a scheduled route of one or more of the selected vehicles to the scheduled destination.

In another embodiment, a method is provided that includes receiving a captured state of vehicles traveling in a transportation network according to associated schedules. The captured state represents locations of the vehicles in the transportation network at a selected time. The method also includes obtaining a proposed modification to one or more selected schedules for one or more of the vehicles. The proposed modification directs the one or more of the vehicles to deviate from the one or more selected schedules. The method further includes simulating movement of the vehicles according to the proposed modification and subsequent to the selected time of the captured state and determining one or more potential ramifications on travel of one or more of the vehicles based on the movement that is simulated. Based on the one or more potential ramifications, the method also includes changing at least one of the selected schedules to include the proposed modification. The at least one of the selected schedules that includes the proposed modification is configured to be communicated to the one or more of the vehicles in order to direct further movement of the one or more of the vehicles.

In another aspect, determining the one or more potential ramifications occurs prior to changing the at least one of the selected schedules to include the proposed modification.

In another aspect, the transportation network is associated with a throughput parameter that is indicative of flow of the vehicles traveling in the transportation network. The one or more potential ramifications on travel of the one or more vehicles can include a simulated change in the throughput parameter.

In another aspect, the method also includes updating the captured state of the vehicles to an updated state by determining actual changes in movements of the vehicles. Determining the one or more potential ramifications on travel can include simulating the movement of the vehicles based on the updated state of the vehicles.

In another aspect, receiving the captured state of the vehicles occurs in response to identification of a slowdown event in the transportation network that reduces or prevents continued travel of one or more of the vehicles.

In another aspect, obtaining the proposed modification includes receiving a plurality of the proposed modifications to the one or more selected schedules and simulating movement of the vehicles includes generating a plurality of different simulations of movement based on the plurality of the proposed modifications. The method can further include selecting at least one of the proposed modifications based on comparisons of the different simulations.

In another aspect, obtaining the proposed modification includes receiving the proposed modification from a user.

In another aspect, the captured state of the vehicles includes at least one of locations of the vehicles or directions of travel of the vehicles at the selected time.

In another aspect, the proposed modification includes one or more of a change in a scheduled arrival time of one or more of the selected vehicles at a scheduled destination location, a change in the scheduled destination location of one or more of the selected vehicles, or a deviation from a scheduled route of one or more of the selected vehicles to the scheduled destination.

In another embodiment, another system includes a resolution module that is configured to receive a plurality of proposed modifications to one or more schedules of one or more vehicles traveling in a transportation network. The plurality of proposed modifications directs the one or more vehicles to deviate from the one or more schedules during travel in the transportation network following a selected time. The resolution module is further configured to select one or more of the proposed modifications based on simulations of travel of the vehicles following the selected time. The one or more proposed modifications are selected based on potential ramifications on travel of the one or more of the vehicles subsequent to the selected time. The resolution module is further configured to direct a scheduling system to change at least one of the schedules into one or more modified schedules that include the one or more proposed modifications that are selected.

In another aspect, the transportation network is associated with a throughput parameter that is indicative of flow of the vehicles traveling in the transportation network. The one or more potential ramifications on travel of the one or more vehicles can include a simulated change in the throughput parameter.

In another aspect, the simulations of travel are updated with actual movements of the vehicles subsequent to the resolution module receiving the proposed modifications to the one or more schedules.

In another aspect, the proposed modifications include one or more of a change in a scheduled arrival time of one or more of the selected vehicles at a scheduled destination location, a change in the scheduled destination location of one or more of the selected vehicles, or a deviation from a scheduled route of one or more of the selected vehicles to the scheduled destination.

Another embodiment relates to a system, e.g., a system for scheduling movement of plural vehicles. The system includes an interface module that is configured to determine a captured state of vehicles traveling in a transportation network according to associated schedules. The captured state is representative of locations of the vehicles in the transportation network at a selected time. The system further includes a simulation module (operably interfaced with the interface module) that is configured to run plural movement simulations of the vehicles according to plural proposed modifications to one or more of the schedules (e.g., there may be one movement simulation run for each proposed modification). The movement simulations commence from the selected time of the captured state of the vehicles (i.e., start at the selected time and move forward in simulation time). The system further includes a resolution module (operably interfaced with the simulation module) that is configured to determine changes in movement of one or more of the vehicles in the movement simulations due to the proposed modifications. The resolution module is further configured to implement a selected one of the proposed modifications based on a comparison of the plural simulations (e.g., implementation may include communicating the selected proposed modification to a scheduling system).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the inventive subject matter, including the best mode, and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "comprises," "including," "includes," "having," or "has" an element or a plurality of elements having a particular property may include additional such elements not having that property.

What is claimed is:

1. A system comprising:

an interface module configured to determine a captured state of vehicles that are actually moving in a transportation network according to associated schedules and a proposed modification to one or more of the schedules, the captured state representing actual locations of the vehicles in the transportation network at a selected time;

a simulation module configured to simulate movement of the vehicles from the actual locations of the vehicles at the selected time according to the proposed modification to the one or more of the schedules, the movement of the vehicles simulated from the selected time of the captured state of the vehicles; and a resolution module configured to determine one or more impacts of implementing the proposed modification to the one or more of the schedules on the movement of the vehicles that is simulated, wherein the resolution module is configured to use the one or more impacts on the movement of the vehicles that is simulated to determine whether to actually implement the proposed modification in actual travel of the vehicles.

2. The system of claim 1, wherein the interface module is configured to communicate the proposed modification to a scheduling system for implementation in the actual travel of the vehicles and the resolution module is configured to determine the one or more impacts on the movement of the vehicles prior to the scheduling system implementing the proposed modification in the one or more of the schedules.

3. The system of claim 1, wherein the transportation network is associated with a throughput parameter that is indicative of flow of the vehicles traveling in the transportation network, and the one or more impacts on the movement of the vehicles includes a simulated change in the throughput parameter.

4. The system of claim 1, wherein the interface module is configured to receive an update to the captured state of the vehicles that reflects changes in actual movements of the vehicles subsequent to the selected time of the captured state, and wherein the simulation module is configured to simulate the movement of the vehicles based on the update to the captured state of the vehicles.

5. The system of claim 1, wherein the interface module is configured to obtain the captured state of the vehicles in response to actual travel of one or more of the vehicles according to the schedules being prevented.

6. The system of claim 1, wherein the interface module is configured to receive a plurality of the proposed modifications, the simulation module is configured to generate a plurality of different simulations of travel of the vehicles based on the plurality of proposed modifications, and the resolution module is configured to determine the one or more impacts of implementing the proposed modification from the plurality of different simulations, further wherein the resolution module is further configured to select at least one of the proposed modifications based on a comparison of the impacts of implementing the proposed modification.

7. The system of claim 1, wherein the interface module is configured to receive the proposed modification from a user.

8. The system of claim 1, wherein the captured state of the vehicles also includes actual directions of travel of the vehicles at the selected time.

9. The system of claim 1, wherein the proposed modification includes one or more of a change in a scheduled arrival time of one or more of the selected vehicles at a scheduled destination location, a change in the scheduled destination location of one or more of the selected vehicles, or a deviation from a scheduled route of one or more of the selected vehicles to the scheduled destination.

10. The system of claim 1, wherein the interface module, the simulation module, and the resolution module are one or more processors.

11. A system comprising:

an interface module configured to determine a captured state of vehicles that actually are moving in a transportation network according to associated schedules, the captured state representing actual locations of the vehicles in the transportation network at a selected time;

a simulation module configured to run plural movement simulations of the vehicles according to plural proposed modifications to one or more of the schedules, the movement simulations commencing from the actual locations of the vehicles and the selected time of the captured state of the vehicles; and a resolution module configured to determine changes in movement of one or more of the vehicles in the movement simulations due to the proposed modifications, wherein the resolution module is configured to implement one of the proposed modifications based on a comparison of the plural simulations.

12. The system of claim 11, wherein the interface module, the simulation module, and the resolution module are one or more processors.

13. A system comprising:

a resolution module configured to receive a plurality of proposed modifications to one or more schedules of one or more vehicles that actually are moving in a transportation network, the plurality of proposed modifications directing the one or more vehicles to deviate from the one or more schedules during actual travel of the one or more vehicles in the transportation network following a selected time, wherein the resolution module is further configured to select one or more of the proposed modifications based on simulations of travel of the vehicles following the selected time, the one or more proposed modifications being selected based on impacts of implementing the proposed modifications on the travel of the vehicles that is simulated subsequent to the selected time, and wherein the resolution module is further configured to direct a scheduling system to change at least one of the schedules into one or more modified schedules that include the one or more proposed modifications that is selected.

14. The system of claim 13, wherein the transportation network is associated with a throughput parameter that is indicative of flow of the vehicles traveling in the transportation network, and the impacts of implementing the proposed modifications include a simulated change in the throughput parameter.

15. The system of claim 13, wherein the simulations of travel are updated with actual movements of the vehicles subsequent to the resolution module receiving the proposed modifications to the one or more schedules.

16. The system of claim 13, wherein the proposed modifications include one or more of a change in a scheduled arrival time of one or more of the selected vehicles at a scheduled destination location, a change in the scheduled destination location of one or more of the selected vehicles, or a deviation from a scheduled route of one or more of the selected vehicles to the scheduled destination.

17. The system of claim 13, wherein the resolution module is one or more processors.

18. A system comprising:

one or more processors configured to obtain a captured state of vehicles that are actually traveling in a transportation network according to associated schedules, the captured state representing actual locations of the vehicles in the transportation network at a selected time, the one or more processors also configured to obtain a proposed modification to one or more selected schedules for one or more of the vehicles, the proposed modification directing the one or more of the vehicles to deviate from the one or more selected schedules, the one or more processors further configured to simulate continued movement of the vehicles from the actual locations and the selected time of the captured state according to the proposed modification, the one or more processors also configured to identify impacts on the movement of the vehicles that is simulated due to the proposed modification and to actually change at least one of the selected schedules using the proposed modification so that continued actual travel of the vehicles is modified by the proposed modification.

19. The system of claim 18, wherein the one or more processors also are configured to monitor continued actual movement of the vehicles from the actual locations of the captured state subsequent to the selected time, the one or more processors also configured to update the movement of the vehicles that is simulated using the continued actual movement of the vehicles.

20. The system of claim 18, wherein the one or more processors are configured to obtain the captured state of the vehicles responsive to actual movement of one or more of the vehicles according to the schedules of the one or more of the vehicles being stopped.

21. The system of claim 18, wherein the one or more processors are configured to obtain a plurality of the proposed modifications to the one or more selected schedules and to simulate the movement of the vehicles by generating a plurality of different simulations of movement based on the plurality of the proposed modifications, the one or more processors also configured to select at least one of the proposed modifications based on comparisons of the different simulations.

22. The system of claim 18, wherein the captured state of the vehicles also includes actual directions of travel of the vehicles at the selected time.

23. The system of claim 18, wherein the proposed modification includes one or more of a change in a scheduled arrival time of one or more of the selected vehicles at a scheduled destination location, a change in the scheduled destination location of one or more of the selected vehicles, or a deviation from a scheduled route of one or more of the selected vehicles to the scheduled destination.

* * * * *